US010276327B2

(12) United States Patent
Chen et al.

(10) Patent No.: US 10,276,327 B2
(45) Date of Patent: Apr. 30, 2019

(54) LUMINOUS KEYBOARD AND LUMINOUS KEYSWITCH THEREOF

(71) Applicant: DARFON ELECTRONICS CORP., Taoyuan (TW)

(72) Inventors: Chih-Hung Chen, Taoyuan (TW); Hsin-Cheng Ho, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 32 days.

(21) Appl. No.: 15/611,079

(22) Filed: Jun. 1, 2017

(65) Prior Publication Data

US 2017/0352504 A1 Dec. 7, 2017

(30) Foreign Application Priority Data

Jun. 4, 2016 (TW) ..... 105117776 A

(51) Int. Cl.
*H01H 13/83* (2006.01)
*H01H 3/12* (2006.01)
*H01H 1/02* (2006.01)

(52) U.S. Cl.
CPC ..... *H01H 13/83* (2013.01); *H01H 1/02* (2013.01); *H01H 3/122* (2013.01); *H01H 3/125* (2013.01);
(Continued)

(58) Field of Classification Search
CPC ..... H01H 13/83; H01H 1/02; H01H 3/122; H01H 3/125; H01H 2215/006; H01H 2219/028
See application file for complete search history.

(56) References Cited

U.S. PATENT DOCUMENTS 6,743,993 B1 * 6/2004 Clark ..... H01H 13/702 200/314
8,173,922 B2 * 5/2012 Chen ..... H01H 13/83 200/314
(Continued)

FOREIGN PATENT DOCUMENTS

TW 200952017 A 12/2009
TW M404472 5/2011
(Continued)

*Primary Examiner* — Kyung S Lee
(74) *Attorney, Agent, or Firm* — Innovation Capital Law Group, LLP; Vic Lin

(57) ABSTRACT

A luminous keyswitch includes a keycap having a light-transparent portion, a baseplate, an up-down mechanism with two ends respectively moveably connected to the keycap and the baseplate, a function sheet disposed on or under the baseplate, and a light source disposed on the function sheet within a vertical projection of the keycap and connected by a copper wire to provide a light illuminating the light-transparent portion. The function sheet includes a flexible upper circuit layer having a first contact point, a flexible spacer layer having a hole, and a flexible lower circuit layer having a second copper contact point, a third copper contact point, a first copper wire connected to the second copper contact point, and a second copper wire connected to the third copper contact point. When the keycap is pressed, the first contact point passes through the hole to electrically connect the second and third copper contact points.

13 Claims, 10 Drawing Sheets

(52) U.S. Cl.
CPC . *H01H 2215/006* (2013.01); *H01H 2219/028* (2013.01); *H01H 2219/04* (2013.01); *H01H 2227/036* (2013.01)

(56) References Cited

U.S. PATENT DOCUMENTS

| | | | | |
|---|---|---|---|---|
| 8,759,698 | B2 * | 6/2014 | Chiba | H01H 3/125 200/310 |
| 8,779,314 | B2 | 7/2014 | Lee et al. | |
| 9,040,856 | B2 * | 5/2015 | Chen | H01H 13/83 200/310 |
| 9,299,515 | B2 | 3/2016 | Chen | |
| 9,384,918 | B2 * | 7/2016 | Chen | H01H 13/704 |
| 2010/0066568 | A1 * | 3/2010 | Lee | H01H 3/125 341/22 |
| 2012/0080297 | A1 * | 4/2012 | Takeuchi | G06F 3/0202 200/310 |
| 2016/0172130 | A1 | 6/2016 | Tsai et al. | |

FOREIGN PATENT DOCUMENTS

| | | |
|---|---|---|
| TW | I489499 | 6/2015 |
| TW | I521557 | 2/2016 |

* cited by examiner

LUMINOUS KEYBOARD AND LUMINOUS KEYSWITCH THEREOF

BACKGROUND OF THE INVENTION

1. Field of the Invention

The invention generally relates to a luminous keyboard and a luminous keyswitch thereof. Particularly, the invention relates to a luminous keyboard and a luminous keyswitch thereof, which has a function sheet.

2. Description of the Prior Art

Keyboards are one of the most important input devices for electronic products, especially for computers. The development of keyboards has a very close relationship with the convenience of users. In order to operate the keyboard properly in a dim-light or dark environment, luminous keyboards gradually become a major choice of consumers. However, the conventional luminous keyboard usually has the backlight module disposed under the keyswitch module, so the overall brightness of the keyboard is less uniform and the total thickness of the keyboard is also increased, not satisfying the thinning requirement.

Therefore, how to effectively integrate the light source into the keyswitch to meet the thinning requirement and to enhance the uniformity of brightness is one of the important issues for keyboard design.

SUMMARY OF THE INVENTION

In view of the prior arts, it is an object of the present invention to provide a luminous keyswitch, which integrates the switch circuit and the light source circuit on a function sheet to achieve the trigger function and light-emitting function simultaneously.

It is another object of the invention to provide a luminous keyswitch, which has a function sheet with copper conductive wires and copper contact points to reduce the electrical resistance and promote the stability of electrical conduction.

In an embodiment, the luminous keyswitch of the invention includes a keycap having a light-transparent portion, a baseplate disposed below the keycap, an up-down mechanism with two ends respectively moveably connected to the keycap and the baseplate, a function sheet disposed on or under the baseplate, the function sheet including a flexible upper circuit layer having a first contact point, a flexible spacer layer having a first hole, and a flexible lower circuit layer having a second copper contact point, a third copper contact point, a first copper wire, and a second copper wire, the first copper wire and the second copper wire respectively connecting the second copper contact point and the third copper contact point, and a light source disposed on the flexible upper circuit layer, the flexible spacer layer, or the flexible lower circuit layer and connected by a copper wire, the light source located within a vertical projection of the keycap to provide a light to illuminate the light-transparent portion. When the keycap is pressed, the first contact point passes through the first hole to electrically connect the second copper contact point and the third copper contact point.

In an embodiment, a material of the flexible upper circuit layer and the flexible lower circuit layer is polyethylene terephthalate (PET).

In an embodiment, the second copper contact point and the third copper contact point have a finger shape or a zigzag shape.

In an embodiment, the first contact point has a circular shape.

In an embodiment, the first contact point is made of a silver paste by screen-printing.

In an embodiment, the luminous keyswitch further includes an insulation glue or an insulation layer covering the light source.

In an embodiment, the luminous keyswitch further includes an elastic member disposed between the keycap and the baseplate, and the light source is located within a vertical projection of the elastic member.

In an embodiment, the up-down mechanism is a scissors type up-down mechanism or a butterfly type up-down mechanism.

In an embodiment, the flexible spacer layer has a second hole. The flexible upper circuit layer has a third hole. The light source is disposed on the flexible lower circuit layer and extends through the second hole and the third hole.

In an embodiment, the light source is disposed on a side of the flexible lower circuit layer opposite to the flexible spacer layer.

In another embodiment, the luminous keyswitch includes a keycap having a light-transparent portion, a baseplate disposed below the keycap, an up-down mechanism with two ends respectively moveably connected to the keycap and the baseplate, a function sheet disposed on or under the baseplate, the function sheet including an upper circuit layer having a first copper contact point and a first copper wire electrically connected to the first copper contact point, a spacer layer having a hole, and a lower circuit layer having a second copper contact point and a second copper wire electrically connected to the second copper contact point, and a light-emitting diode disposed on the upper circuit layer, the spacer layer, or the lower circuit layer and connected by a copper wire, the light-emitting diode located within a vertical projection of the keycap. When the keycap is pressed, the first copper contact point passes through the hole to electrically connect the second copper contact point.

It is a further object of the invention to provide a luminous keyboard including a plurality of the luminous keyswitches described above.

DETAILED DESCRIPTION OF THE PREFERRED EMBODIMENT

Figure 7:
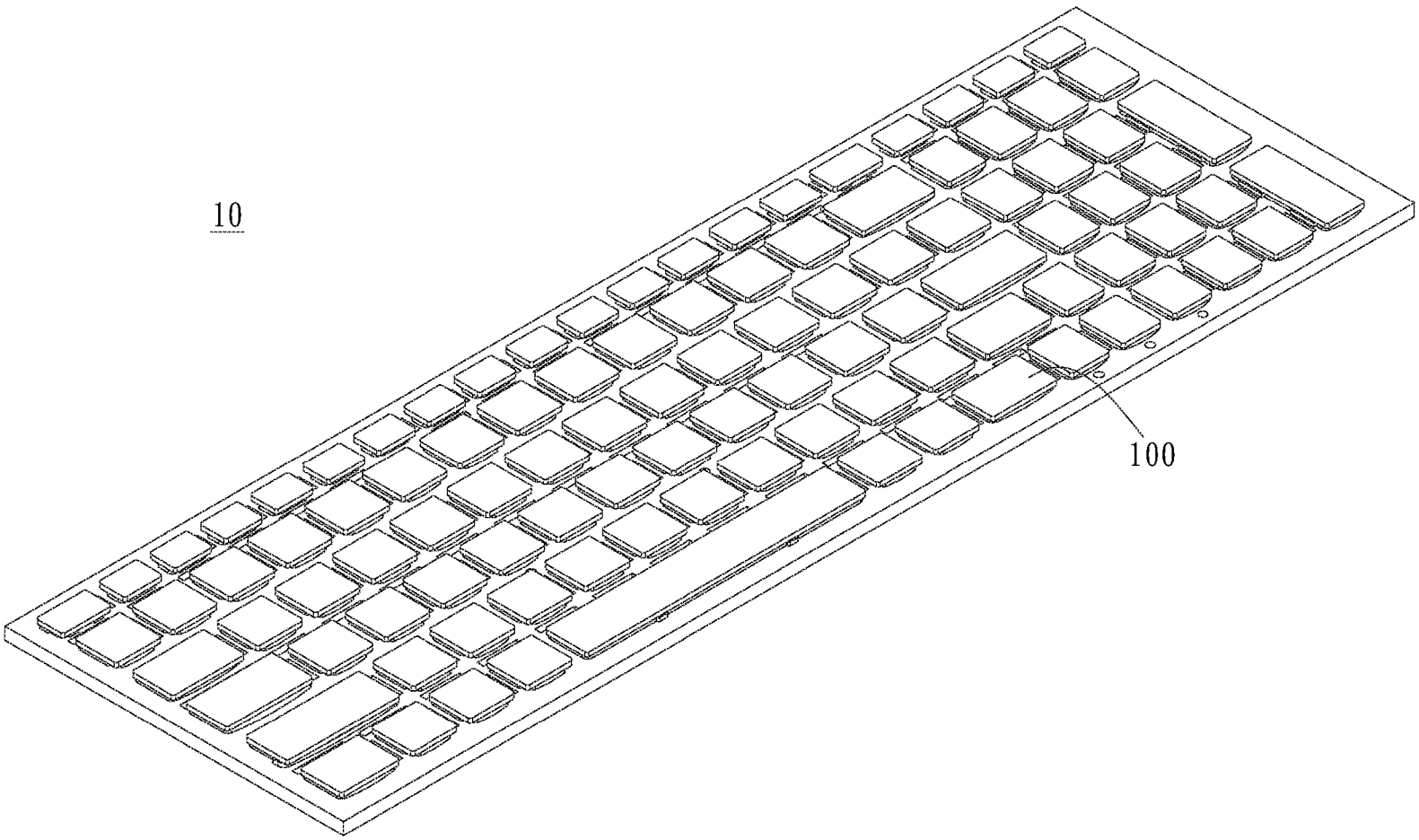
FIG. 7 is a schematic view of an embodiment of the luminous keyboard of the invention.

The invention provides a luminous keyboard and a luminous keyswitch, which has a function sheet to simultaneously achieve a trigger function and a light-emitting function. The luminous keyboard of the invention can be an independent commercial luminous keyboard or a luminous keyboard integrated into the electronic products, such as the keybutton or keyboard equipped in mobile devices, tablet computers. Hereafter, taking the computer keyboard (as shown in FIG. 7) as an example, the luminous keyboard and the luminous keyswitch of the invention will be described in detail with reference to the drawings.

Figure 1A:
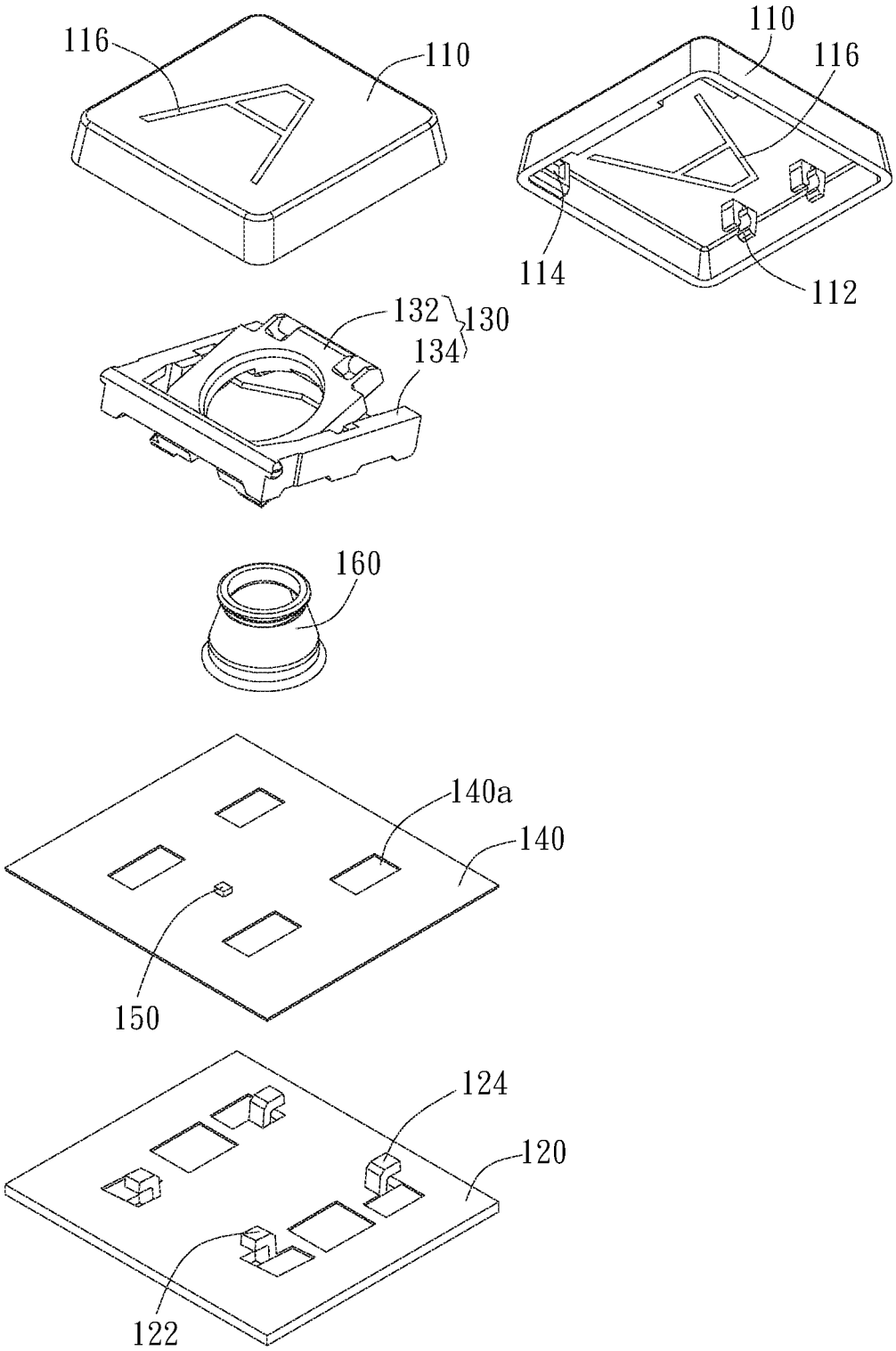
FIGS. 1A and 1B are respectively an exploded view and a cross-sectional view of an embodiment of the luminous keyswitch of the invention.
Figure 1B:
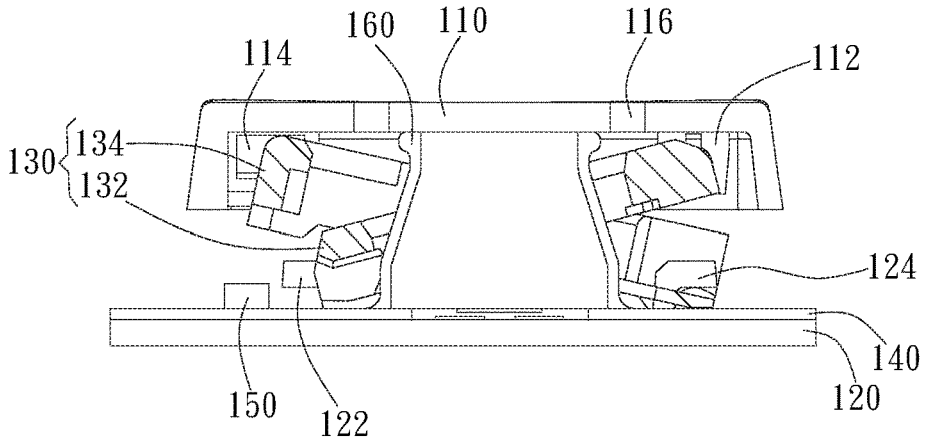
Figure 1C:
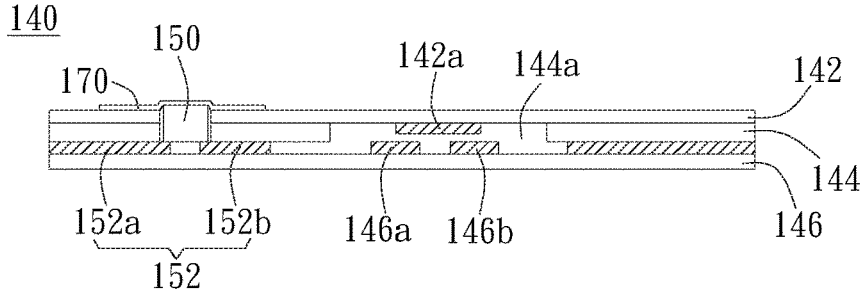
FIG. 1C is a cross-sectional view of a first embodiment of the function sheet of the luminous keyswitch of the invention.

As shown in FIGS. 1A to 1C, in an embodiment, the luminous keyswitch includes a keycap 110, a baseplate 120, an up-down mechanism 130, a function sheet 140, and a light source 150. The baseplate 120 is disposed below the keycap 110, and the two ends of the up-down mechanism 130 are respectively moveably connected to the keycap 110 and the baseplate 120 to support the keycap 110 to move relative to the baseplate 120. Specifically, the up-down mechanism 130 may include a first frame 132 and a second frame 134, which are pivotally connected to constitute a scissors type up-down mechanism, but not limited thereto. The baseplate 120 has coupling members 122, 124 to couple the lower end of the up-down mechanism 130. The coupling members 122, 124 can be, for example, upward bending hook-like member. Correspondingly, the keycap 110 has connecting members 112, 114 to connect the upper end of the up-down mechanism 130. For example, the connecting members 112, 114 can be a pivot hole or a sliding groove, but not limited thereto. In other words, when the up-down mechanism 130 is disposed under the keycap 110, the upper ends of the first frame 132 and the second frame 134 are respectively rotatably and slidably connected to the connecting members 112, 114, and the lower ends of first frame 132 and the second frame 134 are respectively slidably and rotatably coupled with the coupling members 122, 124 of the baseplate 120 to support the keycap 110 to move relative to the baseplate 120.

Moreover, the luminous keyswitch of the invention further includes a restoring unit 160 for providing a restoring force, making the keycap 110 return to its original position after being pressed. For example, the restoring unit 160 can be embodied as an elastic member, such as a rubber dome or a spring, or a magnetic restoring unit such as magnets, so the keycap 110 can return to its original position by the elastic force or the magnetic force. In this embodiment, the restoring unit 160 is illustrated as the elastic member, such as a rubber dome. In another embodiment (not shown), the restoring unit can be the magnets, which provide the magnetic attraction force or the magnetic repulsion force to make the keycap return to its original position. For example, a pair of magnets of same polarity can be respectively disposed on the keycap 110 and the baseplate 120, so the keycap 110 can move back to its original position by the magnetic repulsion force. In another embodiment (not shown), a pair of magnets of opposite polarities can be respectively disposed on the key frame and the keycap, so the keycap can move back to its original position by the magnetic attraction force. It is noted that when the restoring unit is embodied as the magnetic restoring unit, the disposition of the magnetic restoring unit can be changed according to practical applications to effectively provide the restoring force, not limited to the embodiments.

The function sheet 140 can be disposed on or under the baseplate 120. In this embodiment, the function sheet 140 is disposed on the baseplate 120. It is noted that as shown in FIG. 1A, when the function sheet 140 is disposed on the baseplate 120, the function sheet 140 has openings 140*a* corresponding to the coupling members 122, 124 of the baseplate 120, so the coupling members 122, 124 can pass through the openings 140*a* to couple the lower ends of the first frame 132 and the second frame 134. The light source 150 is disposed on the function sheet 140 and provides a light to illuminate the keycap 110. Specifically, the keycap 110 has a light-transparent portion 116, and the light-transparent portion 116 can have a shape of characters, patterns, etc. The light source 150 can be a light-emitting diode (LED), so the light emitted from the light source 150 can emit outward from the light-transparent portion 116 as the light illuminates the keycap 110. The function sheet 140 has a switch circuit and a light source circuit integrated therein to achieve the trigger function and the light-emitting function simultaneously. Specifically, the function sheet 140 is a stack of multiple layers, and the light source 150 is disposed on one of the multiple layers of the function sheet 150. The light source 150 is preferably disposed within a vertical projection of the keycap 110 on the baseplate 120. Various embodiments of the luminous keyswitch will be described according to the configuration of the function sheet 140 and the disposition of the light source 150 on the function sheet 140.

Figure 2A:
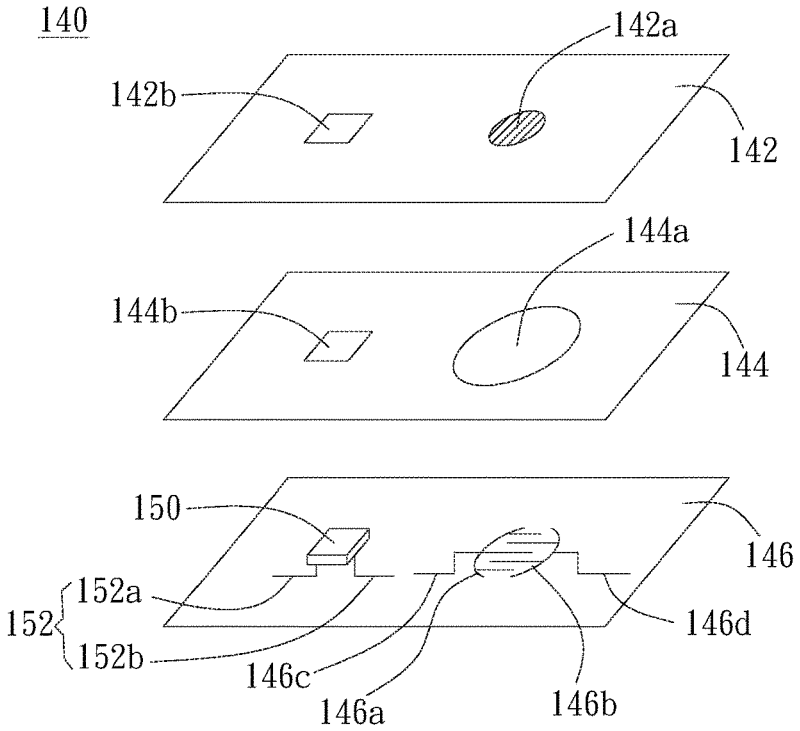
FIG. 2A is an exploded schematic view of a first embodiment of the switch circuit of the function sheet of the luminous keyswitch of the invention.

According to FIGS. 1B-1C and FIG. 2A, in a first embodiment, the function sheet 140 includes an upper circuit layer 142, a spacer layer 144, and a lower circuit layer 146. The upper circuit layer 142, the spacer layer 144, and the lower circuit layer 146 are preferably flexible (or soft), so the function sheet 140 is a flexible function sheet. The material of the upper circuit layer 142, the spacer layer 144, and the lower circuit layer 146 preferably includes polymers, such as polyethylene terephthalate (PET), polycarbonate (PC), or polyimide (PI), and PET is preferred in this embodiment. As shown in the drawings, the upper circuit layer 142 has a first contact point 142*a*, and the first contact point 142*a* preferably has a circular shape, but not limited thereto. In other embodiments, the first contact point 142*a* can have a rectangular, triangular, or ring shape. The first contact point 142*a* can be formed on the lower surface of the upper circuit layer 142*a*, and the first contact point 142*a* can be made of a silver paste by screen-printing or a copper foil by etching. The lower circuit layer 146 has a second copper contact point 146*a*, a third copper contact point 146*b*, a first copper wire 146*c*, and a second copper wire 146*d*. The first copper wire 146*c* and the second copper wire 146*d* are electrically connected to the second copper contact point 146*a* and the third copper contact point 146*b*, respectively. In other words, the lower circuit layer 146 is preferably a circuit layer having the circuit formed on the upper layer by copper foil etching. The first copper wire 146*c* and the second copper contact point 146*a* are electrically isolated from the second copper wire 146*d* and the third copper contact point 146*c*. For example, the lower circuit layer 146 is preferably formed by combining the copper foil with the PET film by using flame retardant and thermal curable resins. Therefore, the lower circuit layer 146 is flame retardant and flexible and has a low electrical resistance and an excellent stability of electrical conduction. The spacer layer 144 is disposed between the upper circuit layer 144 and the lower circuit layer 146 to separate the first contact point 142*a* from the second copper contact point 146*a* and the third copper contact point 146*b*.

Specifically, the spacer layer 144 has a first hole 144*a*. The first contact point 142*a* is disposed corresponding to the first hole 144*a*, and the second copper contact point 146*a* and the third copper contact point 146*b* are also disposed corresponding to the first hole 144*a* and face the first contact point 142*a*. That is, the first contact point 142*a* of the upper circuit layer 142 and the second copper contact point 146*a*, the third copper contact point 146*b*, the first copper wire 146*c*, and the second copper wire 146*d* of the lower circuit layer 146 constitute the switch circuit of the function sheet 140. When the keycap 110 is pressed, the first contact point 142*a* passes through the first hole 144*a* to electrically connect the second copper contact point 146*a* and the third copper contact point 146*b* to generate a trigger signal. Specifically, when the keycap 110 is pressed, the keycap 110 moves downward toward the baseplate 120 by the support of the up-down mechanism 130 and compresses the elastic type restoring unit 160 to push the function sheet 140 by a trigger portion (not shown). As such, the upper circuit layer 142 is deformed downward, and the first contact point 142*a* passes through the first hole 144*a* to electrically connect the second copper contact point 146*a* and the third copper contact point 146*b*. Therefore, the second copper contact point 146*a* and the third copper contact point 146*b* are electrically bridged by the first contact point 142*a* to generate the trigger signal. It is noted that the trigger portion can be disposed on the keycap 110, the restoring unit 160 (such as rubber dome), or the up-down mechanism 130 according to the design needs, so the trigger portion can trigger the switch circuit of the function sheet as the keycap 110 moves downward.

Figure 2B:
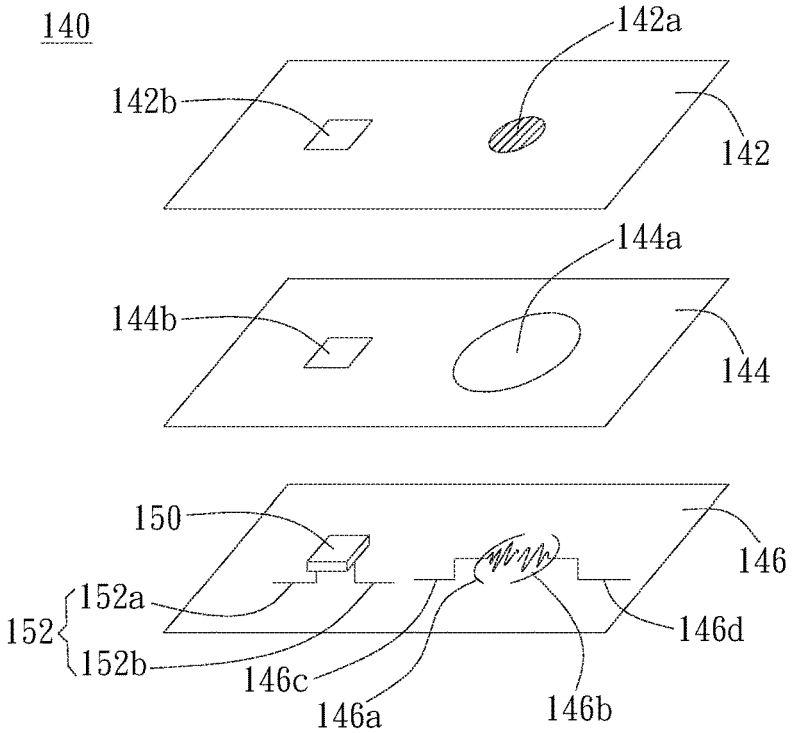
FIG. 2B is an exploded schematic view of a second embodiment of the switch circuit of the function sheet of the luminous keyswitch of the invention.

In an embodiment, as the first example of the switch circuit shown in FIG. 2A, the second copper contact point 146*a* and the third copper contact point 146*b* preferably have a finger shape or a comb shape to improve the stability of electrical conduction. Specifically, the second copper contact point 146*a* and the third copper contact point 146*b* respectively extend from the first copper wire 146*c* and the second copper wire 146*d* toward each other to form alternatively extending finger portions. In another embodiment, as the second example of the switch circuit shown in FIG. 2B, the second copper contact point 146*a* and the third copper contact point 146*b* preferably have a zigzag shape or an S-curved shape to improve the stability of electrical conduction. Specifically, the second copper contact point 146*a* and the third copper contact point 146*b* respectively extend from the first copper wire 146*c* and the second copper wire 146*d* toward each other to form snake-like extending portions. It is noted that the second copper contact point 146*a* and the third copper contact point 146*b* may have different configurations, not limited to the embodiments.

As described above, the light source 150 can be disposed on one of the multiple layers of the function sheet 140. In other words, the light source 150 can be disposed on the upper circuit layer 142, the spacer layer 144, or the lower circuit layer 146. As shown in FIG. 1C and FIG. 2A, in a first embodiment, the light source 150 is disposed on the lower circuit layer 146. Accordingly, the lower circuit layer 146 further has a light source circuit 152, and the light source circuit 152 preferably consists of copper wires 152*a*, 152*b*. That is, when the copper wires 146*c*, 146*d* and the copper contact points 146*a*, 146*b* of the switch circuit are formed on the lower circuit layer 146, the copper wires 152*a*, 152*b* are simultaneously formed on the upper surface of the lower circuit layer 146. Therefore, the function sheet 140 can have the switch circuit and the light source circuit to achieve the trigger function and the light-emitting function simultaneously. When the light source 150 is disposed on the lower circuit layer 146, the spacer layer 144 has a second hole 144*b*, and the upper circuit layer 142 has a third hole 142*b*. The second hole 144*b* communicates with the third hole 142*b* and corresponds to the light source 150, so the light source 150 disposed on the lower circuit layer 146 can extend through the second hole 144*b* and the third hole 142*b*. The luminous keyswitch may further include an insulation glue or an insulation layer 170. The portion of the light source exposed by the third hole 142*b* can be covered by the insulation glue or the insulation layer 170, so as to prevent static electricity damaging the light source 150 during the static electricity test.

Figure 1D:
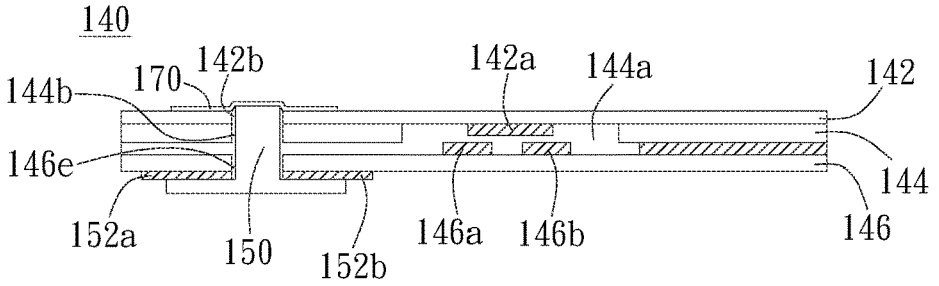
FIGS. 1D and 1E are cross-sectional views of variant embodiments of the function sheet of the luminous keyswitch of the invention.
Figure 1E:
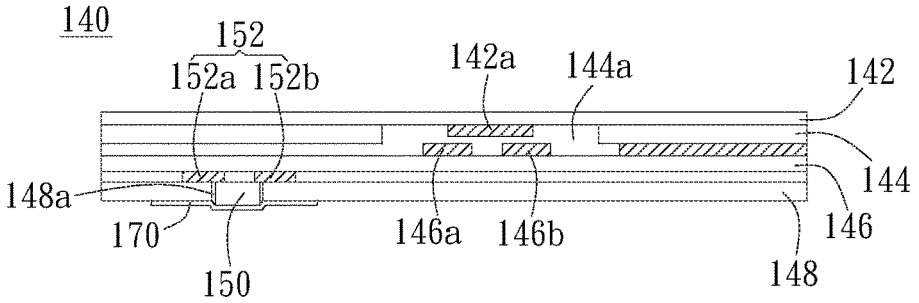

In the embodiment of FIG. 1C, the light source 150 is disposed on the upper surface of the lower circuit layer 146, i.e. on the same surface as the copper contact points 146*a*, 146*b* and the copper wires 146*c*, 146*d*, but not limited thereto. As shown in FIG. 1D, in a variant embodiment, the light source 150 can be disposed on a side of the lower circuit layer 146 that is opposite to the spacer layer 144. For example, the light source 150 can be a reversed light-emitting diode (LED), and the lower circuit layer 146 has circuits formed on two opposite surfaces. In other words, the lower circuit layer 146 has the switch circuit (e.g. the copper contact points 146*a*, 146*b* and the copper wires 146*c*, 146*d*) on the upper surface and the light source circuit (e.g. the copper wires 152*a*, 152*b*) on the lower surface. Therefore, the light source 150 is electrically connected to the side of the lower circuit layer 146 opposite to the spacer layer 144 by the copper wires 152*a*, 152*b*, and extends through the hole 146*e* of the lower circuit layer 146, the second hole 144*b* of the spacer layer 144, and the third hole 142*b* of the upper circuit layer 142 to provide the light toward the keycap 110. It is noted that though the reversed LED is illustrated as the light source 150 in FIG. 1D, in another embodiment a side-LED can be used as the light source 150. As shown in FIG. 1E, the light source 150 is disposed on the lower surface of the lower circuit layer 146 and connected by light source circuit 152 constituted by copper wires. A light guide film 148 can be disposed corresponding to the light source 148, so the light is propagated along the light guide film 148 and guided to emit toward the light-transparent portion 116 of the keycap 110. Specifically, the light guide film 148 has a light source hole 148*a* corresponding to the light source 150. When the light source 150 is disposed on the lower surface of the lower circuit layer 146, the light source 150 is disposed in the light source hole 148*a*, and the light is propagated along the light guide film 148 and directed toward the light-transparent portion 116 of the keycap 110. In an embodiment, the light guide film 148 can be a PET film or a film made of any suitable polymers.

Figure 3A:
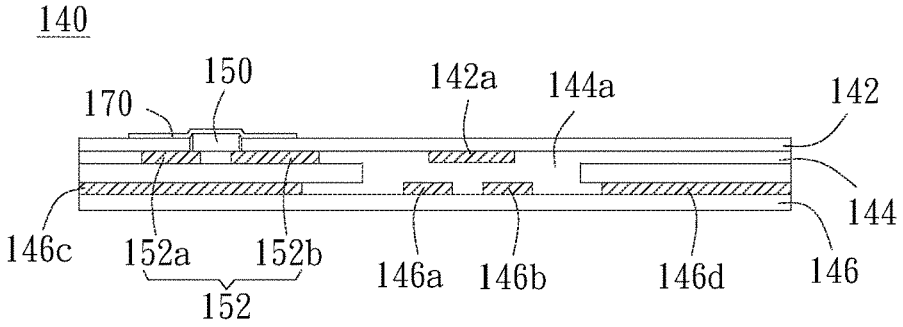
FIGS. 3A and 3B are respectively cross-sectional views of a second embodiment and a variant embodiment of the function sheet of the luminous keyswitch of the invention.
Figure 3B:
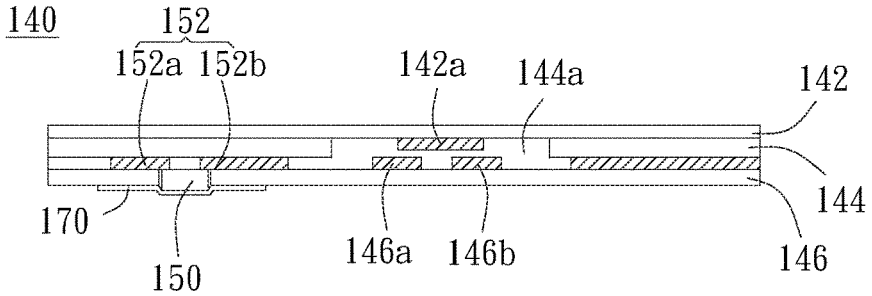
Figure 3C:
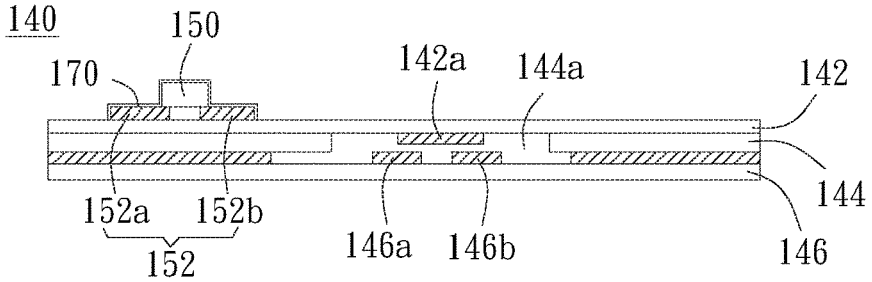
FIG. 3C is a cross-sectional view of a third embodiment of the function sheet of the luminous keyswitch of the invention.

As shown in FIGS. 3A and 3B, in a second embodiment, the light source 150 can be disposed on the spacer layer 144. When the light source 150 is disposed on the spacer layer 144, the spacer layer 144 not only functions as an isolation layer to separate the first contact point 142*a* from the second copper contact point 146*a* and the third copper contact point 146*b*, but also a circuit layer having the light source circuit 152 consisting of copper wires to electrically connect the light source 150. In the embodiment of FIG. 3A, the light source 150 is disposed on the upper surface of the spacer layer 144 and can be embodied as a side LED or a top LED. In the embodiment of FIG. 3B, the light source 150 is disposed on the lower surface of the spacer layer 144, and can be embodied as a reversed LED or a side LED. It is noted that when the light source 150 is disposed on the lower surface of the spacer layer 144, the upper circuit layer 142 can have a hole similar to the hole 142*b* of FIG. 2A, so the light source 150 can extend through the spacer layer 144 and the upper circuit layer 142 to provide the light toward the keycap 110. Moreover, as shown in FIG. 3C, in a third embodiment, the light source 150 can be disposed on the upper surface of the upper circuit layer 142. When the light source 150 is disposed on the upper circuit layer 142, the upper circuit layer 142 preferably has the light source circuit 152 consisting of copper wires to reduce the electrical resistance and promote the stability of electrical conduction, and the first contact point 142*a* formed on the lower surface of the upper circuit layer 142 can be silver paste or copper foil as described. It is noted that when the light source 150 is a reversed LED and disposed on the same lower surface as the first contact point 142*a*, both of the first contact point 142*a* and the light source circuit 152 are preferably formed by the copper foil etching to simplify the manufacturing process. In addition, since the electrical resistance of copper is relatively low, the uniformity of brightness throughout the entire luminous keyboard will not be influenced by the length difference of the light source circuits 152.

Figure 4A:
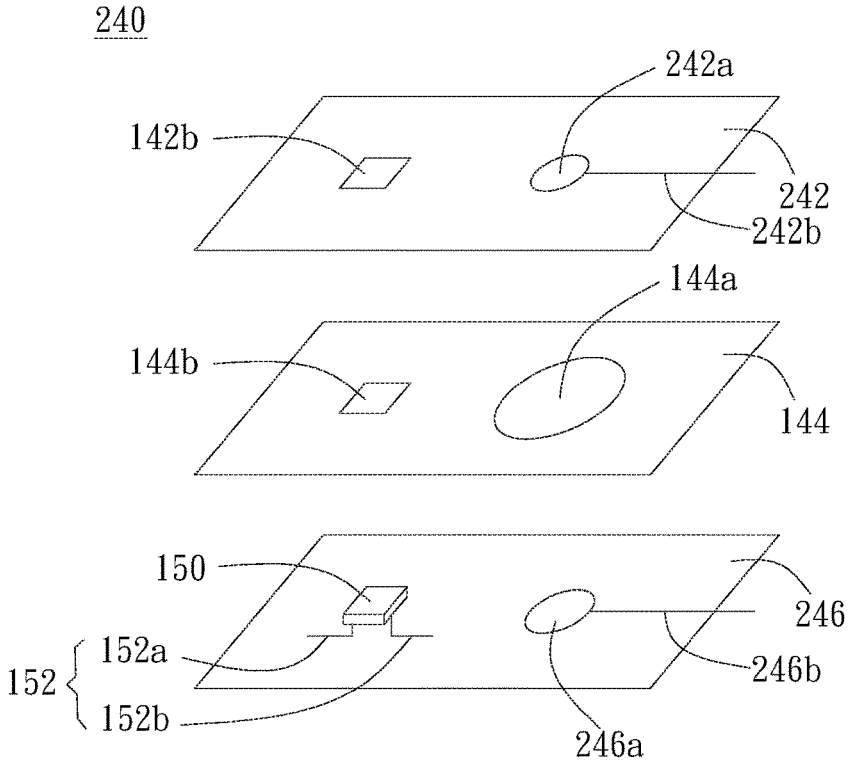
FIGS. 4A and 4B are respectively an exploded view and a cross-sectional view of a third embodiment of the switch circuit of the function sheet of the luminous keyswitch of the invention.
Figure 4B:
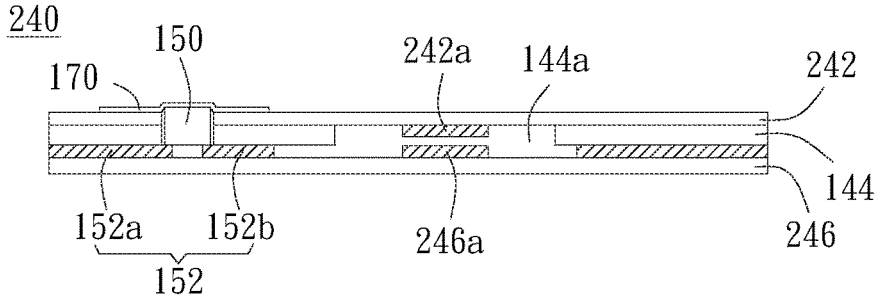

It is noted that the switch circuit of the function sheet can have different configuration, not limited to the embodiment. As shown in FIGS. 4A and 4B, in a third example, the function sheet 240 includes an upper circuit layer 242, a spacer layer 144, and a lower circuit layer 246. The difference between the function sheet 240 and the function sheet 140 is the circuit design in the upper circuit layer 242 and the lower circuit layer 246. The material of each layer of the function sheet 240 and the location of the light source 150 can refer to the related descriptions of the previous embodiments, and will not elaborate again. In this embodiment, the upper circuit layer 242 has a first copper contact point 242*a* and a first copper wire 242*b* electrically connected to the first copper contact point 242*a*. The lower circuit layer 246 has a second copper contact point 246*a* and a second copper wire 246*b* electrically connected to the second copper contact point 246*a*. In other words, the switch circuit on the first upper circuit layer 242 and the lower circuit layer 246 is preferably made of copper material. The first contact point 242*a* and the second copper contact point 246*a* preferably have a shape with larger area (such as circular shape or any suitable shape) than the first copper wire 242*b* and the second copper wire 246*b* to increase the electrical contact area. The spacer layer 144 disposed between the upper circuit layer 242 and the lower circuit layer 246 to isolate the first copper contact point 242*a* and the second copper contact point 246*a*. Similarly, the spacer layer 144 has a hole 144*a*, and the first copper contact point 242*a* and the second copper contact point 246*a* are disposed corresponding to the hole 144*a* and face toward each other. When the keycap is pressed, the first copper contact point 242*a* passes through the hole 144*a* to electrically connect the second copper contact point 246*a* to generate the trigger signal.

Figure 5A:
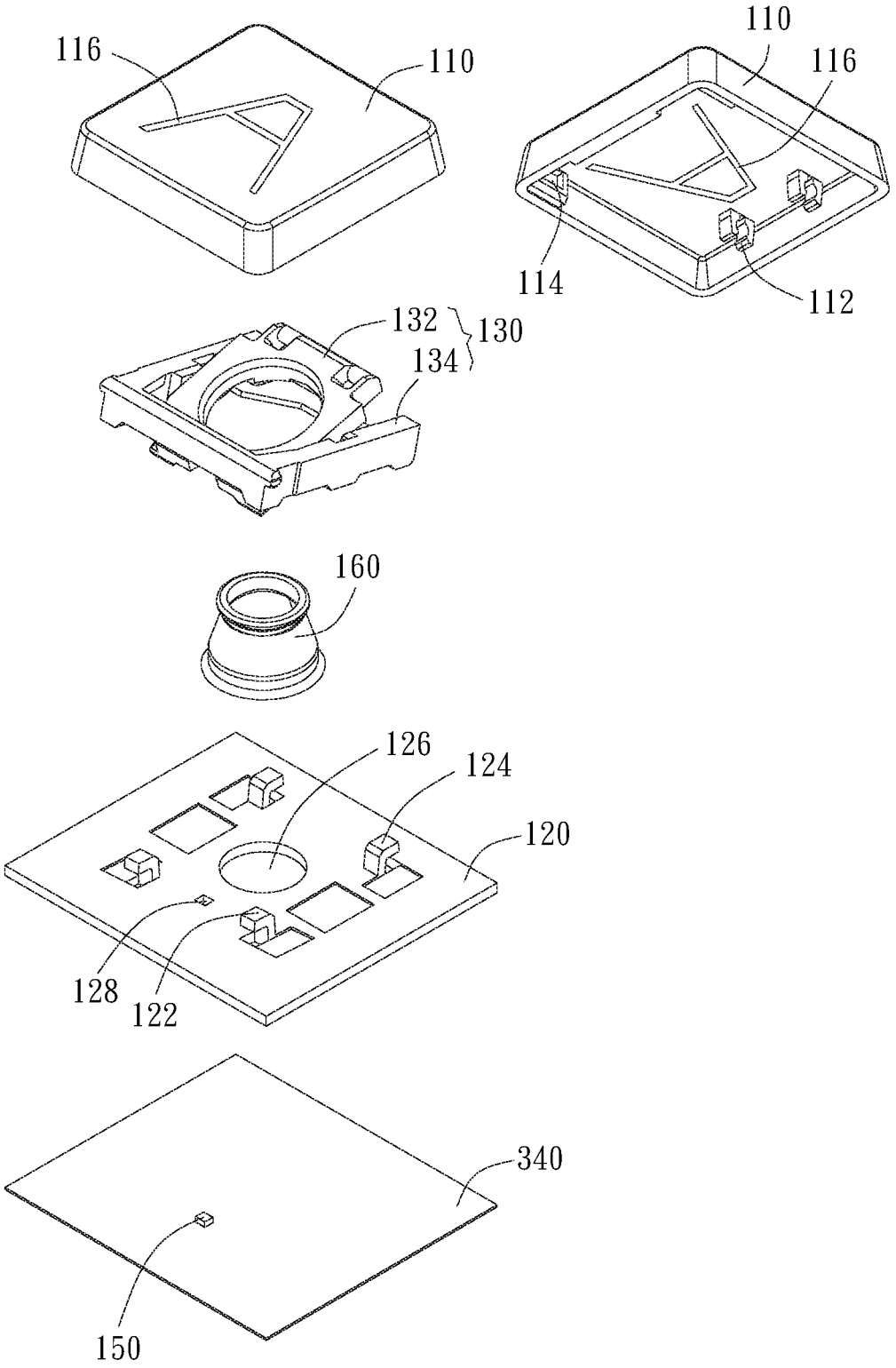
FIGS. 5A and 5B are respectively an exploded view and a cross-sectional view of another embodiment of the luminous keyswitch of the invention.
Figure 5B:
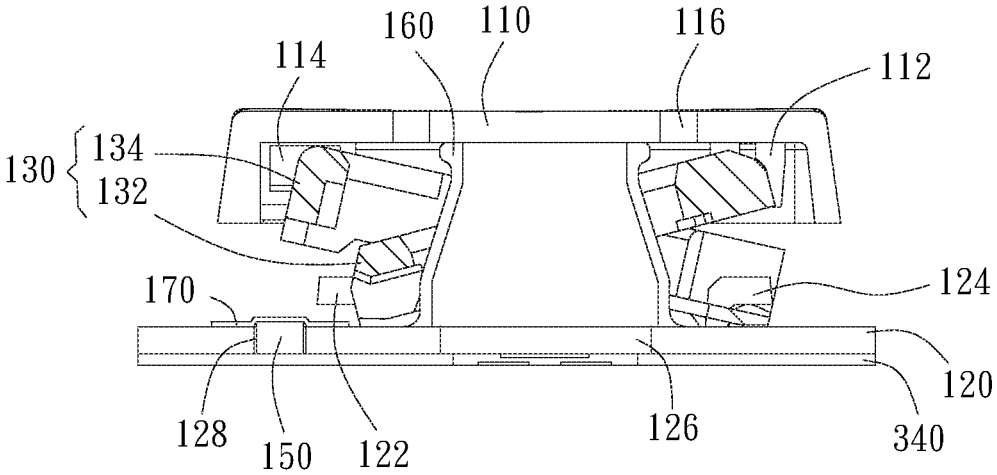
Figure 5C:
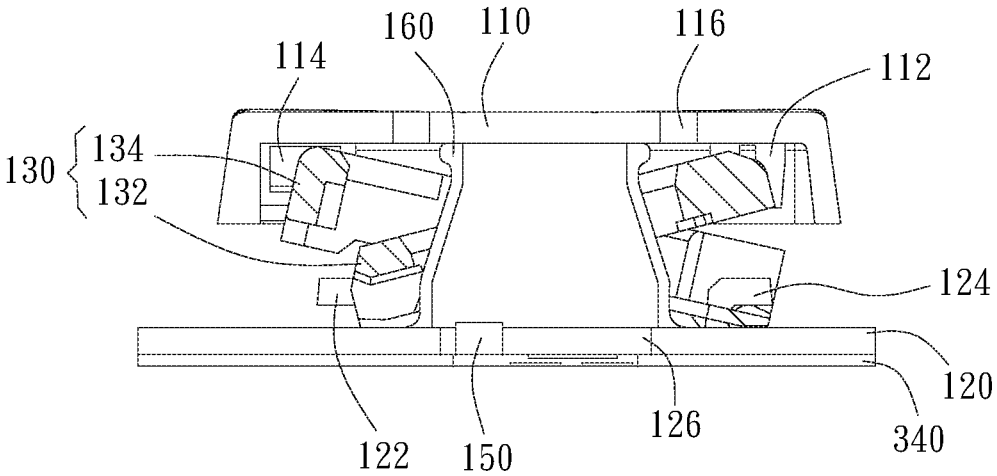
FIG. 5C is a cross-sectional view of a variant embodiment of FIG. 5A.

In another embodiment, as shown in FIGS. 5A and 5B, a function sheet 340 is disposed under the baseplate 120. When the function sheet 340 is disposed under the baseplate 120, the baseplate 120 preferably has an opening 126 corresponding to the switch circuit of the function sheet 340, i.e. corresponding to the hole 144*a* of the spacer layer 144. Therefore, when the keycap 110 is pressed, the trigger portion described above (not shown) will extend into the opening 126 to trigger the function sheet 340 to generate the trigger signal. Corresponding to the location of the light source 150, the baseplate 120 preferably has a light source hole 128, so the light source 150 can extend out from the function sheet 340 into the light source hole 128 to provide the light illuminating the light-transparent portion 116 of the keycap 110. As shown in FIG. 5C, in a variant embodiment, the light source 150 is preferably disposed within a vertical projection of the elastic member 160, such as at a position closer to the center portion of the keycap 110, so as to achieve a more uniform distribution of light. In other words, when the opening 126 has an appropriate size, the light source 150 can be located in the opening 126 to eliminate the formation of the light source hole. It is noted that the function sheet 340 can have a configuration similar to any configurations as described above (e.g. 140, 240).

Figure 6A:
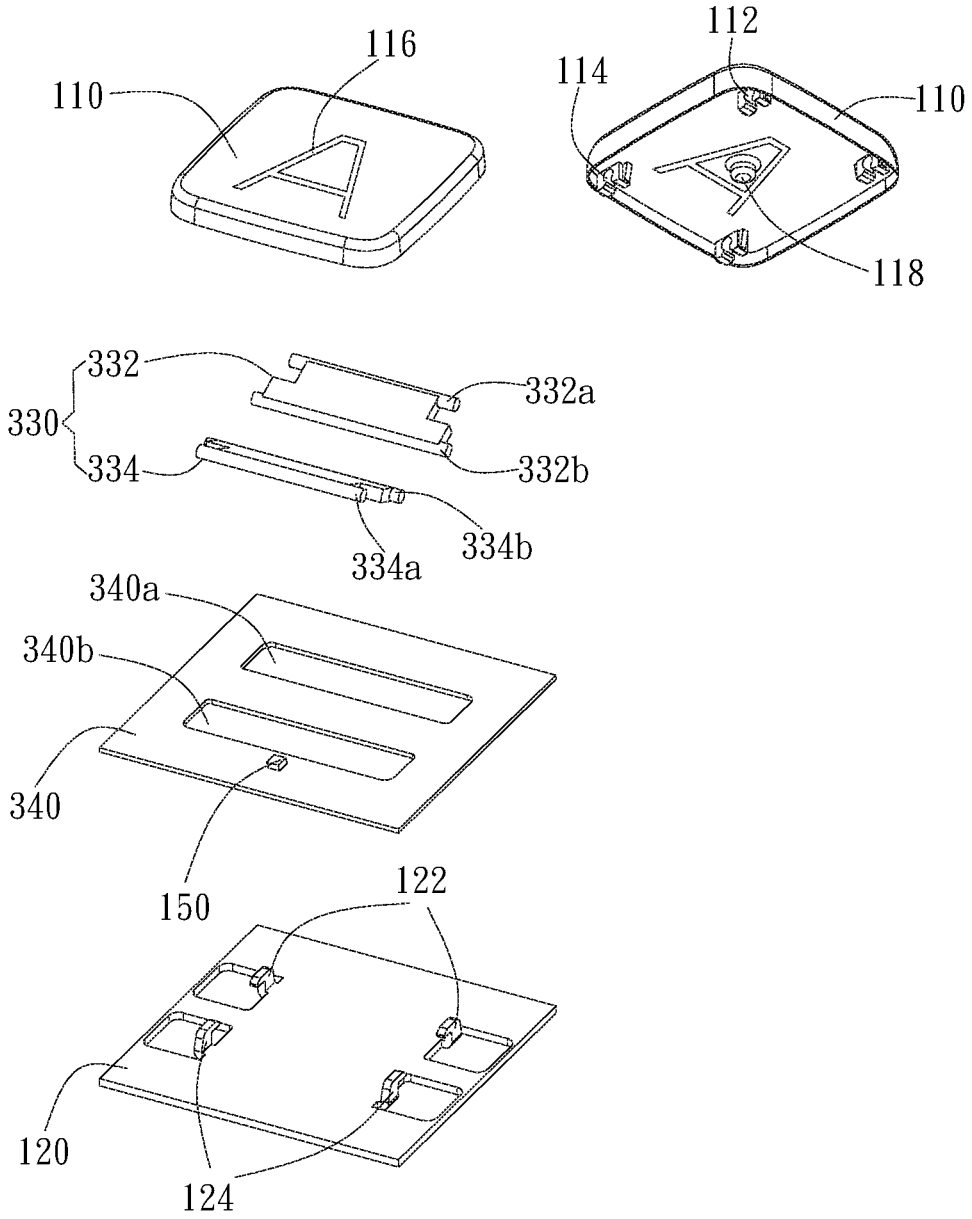
FIGS. 6A and 6B are respectively an exploded view and a cross-sectional view of another embodiment of the luminous keyswitch of the invention.
Figure 6B:
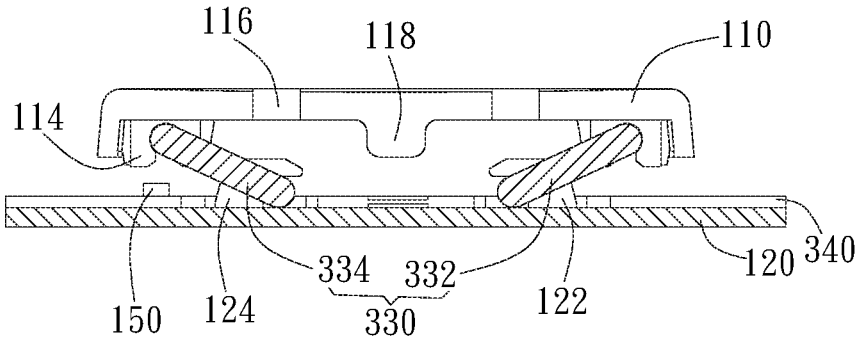
Figure 6C:
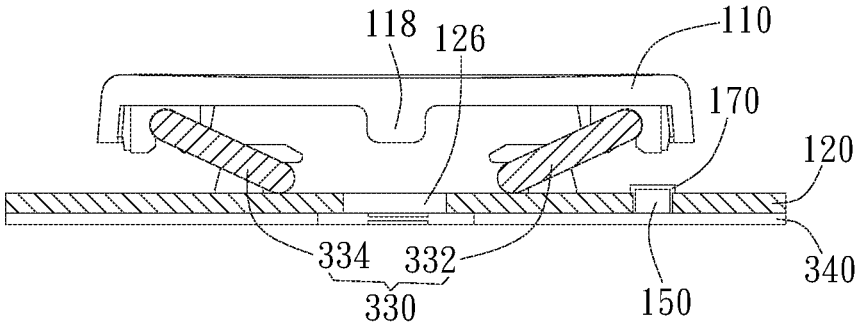
FIG. 6C is a cross-sectional view of a variant embodiment of FIG. 6A.

Moreover, though the scissors type up-down mechanism is illustrated in the above embodiments, the up-down mechanism may have different configurations. As shown in FIGS. 6A and 6B, the up-down mechanism 330 can be embodied as a butterfly type up-down mechanism. Specifically, the up-down mechanism 330 has two frames 332, 334 respectively disposed on two opposite sides of the keycap 110. Each of the frames 332, 334 is rotatably connected to the keycap 110 and movably couples with the baseplate 120 to support the two opposite sides of the keycap 110 and to form a butterfly-like up-down mechanism. In this embodiment, the frames 332, 334 each has a rotating portion 332*a*, 334*a* and a sliding portion 332*b*, 334*b* corresponding to the keycap 110 and the baseplate 120, respectively. Correspondingly, the keycap 110 has connecting members 112, 114 to rotatably connect the rotating portion 332*a*, 334*a*, and the baseplate 120 has coupling members 122, 124 to slidably couple with the sliding portion 332*b*, 334*b*. It is noted that as shown in FIG. 6A, when the function sheet 340 is disposed on the baseplate 120, the function sheet 340 has openings 340*a*, 340*b* corresponding to the coupling members 122, 124 of the baseplate 120, so the coupling members 122, 124 can pass through the openings 340*a*, 340*b* to couple the sliding portion 332*b*, 334*b* of the frames 332, 334. Similarly, the function sheet 340 can be disposed on the baseplate 120 (as shown in FIG. 6B) or under the baseplate 120 (ash sown in FIG. 6C) and can have a configuration similar to any configurations as described above (e.g. 140, 240). When the function sheet 340 is disposed under the baseplate 120, the baseplate 120 preferably has the opening 126 corresponding to the switch circuit of the function sheet 340, i.e. corresponding to the hole 144*a* of the spacer layer 144. Therefore, when the keycap 110 is pressed, the trigger portion 118 will extend into the opening 126 to trigger the function sheet 340 to generate the trigger signal.

As shown in FIG. 7, in another embodiment, the invention provides a luminous keyboard 10. The luminous keyboard includes a plurality of luminous keyswitch 100, which can have a configuration described in at least one of FIG. 1A to FIG. 6C to have the function sheet integrating the switch circuit and the light source circuit for achieving the trigger function and the light-emitting function and to integrate the light source into each keyswitch to benefit the thinning of keyswitch and promote the brightness uniformity of the keyboard. Moreover, the luminous keyboard 10 and the luminous keyswitch 100 has the function sheet with copper wires and copper contact points, so the electrical resistance can be reduced and the stability of electrical conduction can be improved.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A luminous keyswitch, comprising:

a keycap having a light-transparent portion;

a baseplate disposed below the keycap;

an up-down mechanism with two ends respectively moveably connected to the keycap and the baseplate;

a function sheet disposed on or under the baseplate, the function sheet comprising:

a flexible upper circuit layer having a first contact point;

a flexible spacer layer having a first hole; and a flexible lower circuit layer having a second copper contact point, a third copper contact point, a first copper wire, and a second copper wire, the first copper wire and the second copper wire respectively connecting the second copper contact point and the third copper contact point; and a light source connected by a copper wire, the copper wire formed on a side of the flexible upper circuit layer opposite to the first contact point or formed on a side of the flexible lower circuit layer opposite to the second copper contact point, the third copper contact point, the first copper wire, and the second copper wire, the light source located within a vertical projection of the keycap to provide a light to illuminate the light-transparent portion, wherein when the keycap is pressed, the first contact point passes through the first hole to electrically connect the second copper contact point and the third copper contact point.

2. The luminous keyswitch of claim 1, wherein a material of the flexible upper circuit layer and the flexible lower circuit layer is polyethylene terephthalate.

3. The luminous keyswitch of claim 1, wherein the second copper contact point and the third copper contact point have a finger shape or a zigzag shape.

4. The luminous keyswitch of claim 1, wherein the first contact point has a circular shape.

5. The luminous keyswitch of claim 1, wherein the first contact point is made of a silver paste by screen-printing.

6. The luminous keyswitch of claim 1, further comprising an insulation glue or an insulation layer covering the light source.

7. The luminous keyswitch of claim 1, further comprising an elastic member disposed between the keycap and the baseplate, wherein the light source is located within a vertical projection of the elastic member.

8. The luminous keyswitch of claim 1, wherein the up-down mechanism is a scissors type up-down mechanism or a butterfly type up-down mechanism.

9. The luminous keyswitch of claim 1, wherein the flexible spacer layer has a second hole; the flexible upper circuit layer has a third hole; the flexible lower circuit layer has a hole; the light source is disposed on the flexible lower circuit layer and extends through the hole, the second hole and the third hole.

10. The luminous keyswitch of claim 9, further comprising an insulation glue or an insulation layer covering a portion of the light source exposed by the third hole.

11. The luminous keyswitch of claim 9, wherein the light source is disposed on a side of the flexible lower circuit layer opposite to the flexible spacer layer.

12. A luminous keyboard comprising a plurality of the luminous keyswitches of claim 1.

13. A luminous keyswitch, comprising:

a keycap having a light-transparent portion;

a baseplate disposed below the keycap;

an up-down mechanism with two ends respectively moveably connected to the keycap and the baseplate;

a function sheet disposed on or under the baseplate, the function sheet comprising:

an upper circuit layer having a first copper contact point and a first copper wire electrically connected to the first copper contact point;

a spacer layer having a hole; and a lower circuit layer having a second copper contact point and a second copper wire electrically connected to the second copper contact point; and a light-emitting diode connected by a copper wire, the copper wire formed on a side of the upper circuit layer opposite to the first copper contact point and the first copper wire, or formed on a side of the lower circuit layer opposite to the second copper contact point and the second copper wire, the light-emitting diode located within a vertical projection of the keycap, wherein when the keycap is pressed, the first copper contact point passes through the hole to electrically connect the second copper contact point.

* * * * *